United States Patent [19]

Georgis, II

[11] Patent Number: 4,712,095

[45] Date of Patent: Dec. 8, 1987

[54] REMOTE TEMPERATURE ALARM FOR STOVES

[76] Inventor: Paul F. Georgis, II, 23 S. 11th St., Easton, Pa. 18042

[21] Appl. No.: 891,630

[22] Filed: Aug. 1, 1986

[51] Int. Cl.[4] ..... G08B 17/06

[52] U.S. Cl. ..... 340/584; 340/596

[58] Field of Search ..... 340/584, 588, 540, 596, 340/586

[56] References Cited

U.S. PATENT DOCUMENTS 4,399,428 8/1983 Hughes et al. ..... 340/584

4,585,926 4/1986 Easthill ..... 340/584

OTHER PUBLICATIONS

Chimney Fire Alert System–Vermont Technology Group Inc.

*Primary Examiner*—Glen R. Swann, III

*Attorney, Agent, or Firm*—Ruth Moyerman

[57] ABSTRACT

A temperature probe is inserted in the stove pipe and connected to the alarm via an electrical conductor. The alarm unit is capable of triggering on either a "high" or a "low" temperature condition. The "high" condition represents the flashpoint of creosote, which is known as the cause of most fires in woodburning stoves. The "low" alarm is set to trigger at a temperature near the minimum required to maintain the fire so as to alert the owner that the stove is about to go out. In accordance with the present invention, it is possible to override this "low" temperature alarm when desired. The present alarm unit also contains a visual display of the current stove pipe temperature to allow the owner to adjust the fire conditions well before a dangerous situation arises.

8 Claims, 2 Drawing Figures

REMOTE TEMPERATURE ALARM FOR STOVES

BACKGROUND OF THE INVENTION

1. Field of the Invention

The present invention relates to a remote alarm unit and more particularly to an alarm unit for use with, for example, wood or coal stoves which provides both a visual and audible alarm in response to either a "low" temperature or a "high" temperature dangerous condition.

2. Description of the Prior Art

Woodburning stoves, although popular in many areas, are sometimes considered more dangerous than other conventional means of heating a home. For example, chimney fires are common in woodburning stoves due to the buildup of creosote in the chimney area. Creosote is a by-product of the actual burning of the wood, where unseasoned lumber is known to quickly create a relatively large creosote buildup.

Another problem with woodburning stoves is that they need to be closely monitored to keep the fire in the desired temperature range. Different types of wood are known to require different drafting conditions where, unless the correct draft condition is maintained, the fire will become cool and eventually go out.

There do exist various alarm units which may be utilized in conjunction with woodburning stoves. These units commonly attach directly to the flue of the stove and sound an audible alarm when the flue temperature is nearing the ignition level for creosote. A problem with this type of alarm is that it must be directly mounted on the flue where the presence of an extreme temperature condition may cause the alarm unit itself to heat up and fail before a warning can be sounded. Additionally, this type of alarm unit is not capable of giving any indication of the present operating temperature of the stove so that drafting conditions may be adjusted well before the flue temperature rises to the flashpoint of the creosote. Further, these alarms do not provide for a "low" temperature alarm condition to warn the owner that the fire in the stove is about to go out.

SUMMARY OF THE INVENTION

The problems discussed above with conventional alarm units are overcome in accordance with the present invention which relates to a woodstove remote alarm unit and, more particularly, to an alarm unit which provides both a visual and audible alarm in response to either one of a "low" temperature or a "high" temperature danger condition.

It is an aspect of the present invention to be able to locate the actual alarm unit at a remote location from the stove itself by transferring the temperature recording from the stove pipe to the alarm unit over a length of electrical wire. This feature insures that the flue temperature will not affect the performance of the device and also allows the owner to place the alarm unit at a location which is most convenient for him.

Another aspect of the present invention is to provide a continuous visual display of the temperature inside the stove pipe so as to give the owner an indication of the present operating temperature of the stove. This is useful information for warning the owner of conditions nearing both the "low" and "high" temperature conditions. A readout formed with light emitting diodes (LEDs), for example, may be used for this purpose.

A further aspect of the present invention is the ability to override the audible alarm and switch it off once the owner has been alerted to the problem situation.

Other and further aspects of the present invention will become apparent during the course of the following discussion and by reference to the accompanying drawings.

DETAILED DESCRIPTION OF THE PREFERRED EMBODIMENT(S)

Figure 1:
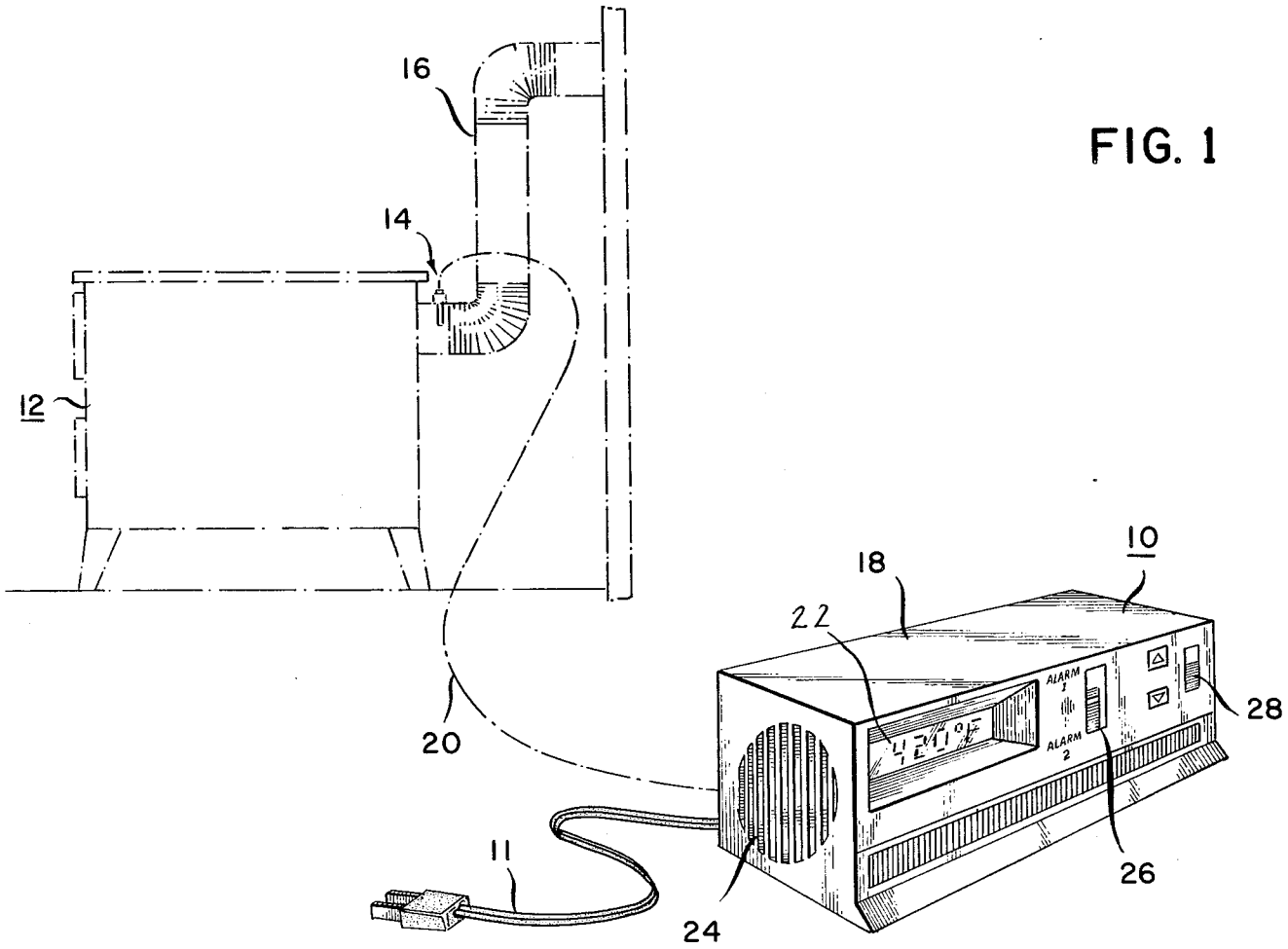
FIG. 1 illustrates a woodburning stove and an exemplary arrangement of a remote alarm unit formed in accordance with the present invention.

FIG. 1 illustrates an exemplary arrangement of a remote alarm unit 10 of the present invention for use with a conventional woodburning stove 12. It is to be understood that alarm unit 10 may be used with many other types of stoves; for example, coal stoves and combination wood/coal burning stoves. Remote alarm unit 10 contains a temperature sensing probe 14 which is inserted in stove pipe 16 of stove 12. Heat probe 14 is then connected through housing 18 to the electronic circuit inside housing 18 of alarm 10 via an electrical conductor 20. This attribute allows the alarm unit to be positioned remotely from the actual sensor. However, it is required that remote alarm unit 10 be positioned in close proximity to an electrical outlet since the unit requires a 60 Hz Ac power signal, supplied by lead 11, to provide the power to the circuitry used inside of alarm 10.

Heat probe 14 is typically a thermistor which converts the temperature inside stove pipe 16 into an electrical signal where the value of the electrical signal is indicative of the temperature. That is, as the temperature rises, the current produced by the thermistor will also increase.

Alarm unit 10 includes a visual display 22 which indicates the operating temperature of stove 12. Display 22 is illustrated in FIG. 1 as a digital readout, for example a liquid crystal display (LCD), which indicates the temperature in degrees Farenheit. Obviously, alarm unit 10 could be re-calibrated to display the temperature in degrees Centigrade, if desired.

Circuits well known in the art are used to convert the incoming current signal on electrical conductor 16 into a signal which drives display 22 to indicate the correct temperature. For example, alarm unit 10 may be set up to illustrate temperature readings in 5 degree, 10 degree or even 1 degree increments, if desired. A simple look-up table in a read-only memory (ROM) unit may be used to convert the incoming current level to the output temperature reading. Other arrangements, for example discrete circuit arrangements, may be used. This type of circuit will be further discussed in association with the arrangement illustrated in FIG. 2.

As discussed above, in addition to visual display 22, alarm unit 10 contains an audible alarm 24 which will be activated on either a "high" or "low" temperature condition. This is represented on alarm unit 10 by slide switch 26 which may be set at the "alarm 1" position ("high" temperature), "alarm 2" position ("low" temperature alarm), or at the "auto" setting which will cause the unit to trigger under either condition. In particular, the "high" alarm may be designed to sound when the temperature in stove pipe 16 is, for example, ten degrees less than the flashpoint of creosote (650° F.). Therefore, once the temperature in stove pipe 16 reaches 640° F., the alarm will sound. For the low temperature setting, alarm 10 may be designed to trigger at a temperature of, for example, 200° F., where it is known that at temperatures less than 200° F. a wood fire cannot be maintained. The ability to choose either one or both of these alarm conditions is a desirable feature. For example, when the fire is first lit, the temperature will obviously be less than 200° F. for a certain period of time. Therefore, the "low" alarm may be deactivated to prevent the sounding of audible alarm 24.

As with display 22, there exists many conventional circuit arrangements capable of triggering audible alarm 24. For example, threshold detectors may be used which will transmit an activating signal to audible alarm 24 when the incoming current on conductor 20 is either greater than that associated with a temperature of 650° F. or less than that associated with a temperature of 200° F. Alternatively, the ROM unit mentioned above could be programmed so that the incoming currents associated with either of the "high" or "low" temperature danger conditions would cause the ROM to transfer a triggering signal to audible alarm 24. Such arrangements are conventional uses of a ROM, well known in the art, and need not be described in detail to appreciate the teachings of the present invention.

Alarm unit 10 also includes a reset switch 28 which allows the owner to turn off audible alarm 24 once he has been alerted to the dangerous condition. This disable, however, will not affect the temperature indicated by display 22. Additionally, alarm 20 may contain an automatic telephone dialing arrangement which is capable of initiating a phone call to the local fire station when the "high" alarm is activated. This type of automatic dialer is well known in the art and various models may be used in conjunction with alarm 10 of the present invention.

Figure 2:
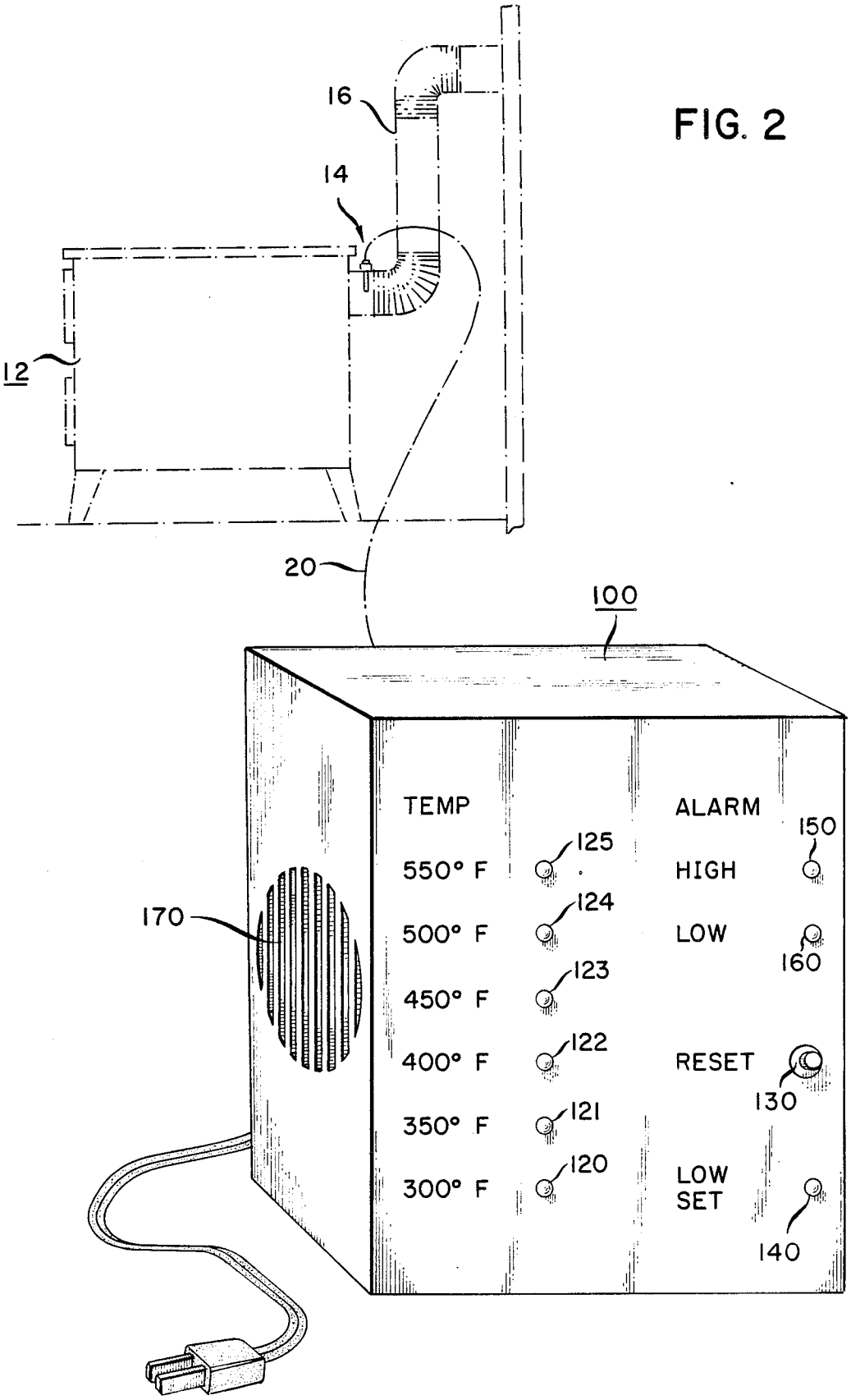
FIG. 2 illustrates an alternative remote alarm unit of the present invention.

An alternative alarm unit 100 of the present invention is illustrated in FIG. 2. In this arrangement, a series of discrete LEDs 120–125 is used to indicate the temperature in stove pipe 16. For example, as shown in FIG. 2, a first LED 120 is used to indicate when the temperature in stove pipe 16 has reached the value of 300° F., a second LED 121 is used to indicate when the temperature has reached a value of 350° F., LED 122 to indicate 400° F., and so on, with LED 125 indicating a stove pipe temperature of 550° F. It is to be understood that these specific temperature values and increments between values are for illustrative purposes only. Obviously, a larger number of LEDs can be used to display the stove pipe temperature with a smaller increment between indicated values.

LEDs 120–125 may be connected so that as the associated temperature is exceeded the LED remains lit, or alternatively, so that only the LED associated with the current temperature will light. LED array 120–125, although perhaps not as accurate as the digital display 22 of FIG. 1, allows for a wider viewing angle of the temperature display due to the nature of the LEDs themselves. Additionally, simpler circuitry may be utilized to provide the LED temperature display. For example, the incoming electrical signal on cable 20 is merely applied as an input to a set of operational amplifiers, each amplifier associated with a separate one of LEDs 120–125. Each LED includes resistor biasing so that the output of the operational amplifier will turn on its LED only when the associated temperature condition is met.

Alarm unit 100 also includes a reset button 130 and a "Low Set" indicator LED 140. Reset button 130 is utilized to either activate or de-activate the operation of the low temperature alarm, where "Low Set" LED 140 will light when the low temperature alarm condition has been activated. Visual indications of the presence of either alarm condition are provided by a "high alarm" LED 150 and a "low alarm" LED 160. Audio alarm 170 associated with unit 100 is identical to that described above for alarm unit 10. To de-activate audible alarm 170 on unit 100, reset button 130 may again be depressed to turn off the buzzer. However, alarm LED 150 or 160 will remain lit until the dangerous condition has been resolved.

What is claimed is:

1. A remotely located temperature alarm for stoves comprising:

(a) a temperature probe for insertion into a stove pipe of said stove;

(b) electrical connection means between said temperature probe and a remotely located portion of said alarm; and, (c) alarm means in said remotely located portion including a visual temperature display and an audible alarm means, said audible alarm means generating an audible alarm signal during the presence of either one of a "low" temperature and a "high" temperature alarm condition at said stove pipe.

2. A temperature alarm as defined in claim 1 which further comprises switching means for de-activating the low temperature alarm of said alarm means.

3. A temperature alarm as defined in claim 1 which further comprises a disabling means capable of de-activating the audible alarm means subsequent to the generation of said audible alarm signal.

4. A temperature alarm as defined in claim 1 wherein the temperature probe comprises a thermistor which is capable of converting the stove pipe temperature into an electrical signal.

5. A temperature alarm as defined in claim 1 wherein the visual temperature display is a digital temperature readout.

6. A temperature alarm as defined in claim 1 wherein the visual temperature display comprises a plurality of light emitting diodes, each diode associated with a predetermined temperature value in the desired operating range of the stove.

7. A temperature alarm as defined in claim 1 wherein the "high" temperature alarm is defined as the flashpoint of creosote.

8. A temperature alarm as defined in claim 1 wherein the "low" temperature alarm is defined as approximately 200° F.

* * * * *